US007972191B2

(12) United States Patent
Ohashi et al.

(10) Patent No.: US 7,972,191 B2
(45) Date of Patent: Jul. 5, 2011

(54) MANUFACTURING METHOD OF IMAGE DISPLAY APPARATUS

(75) Inventors: Yasuo Ohashi, Hadano (JP); Mitsutoshi Hasegawa, Yokohama (JP); Shigeto Kamata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 12/536,886

(22) Filed: Aug. 6, 2009

(65) Prior Publication Data

US 2010/0035507 A1 Feb. 11, 2010

(30) Foreign Application Priority Data

Aug. 11, 2008 (JP) ..... 2008-206567

(51) Int. Cl.
*H01J 9/39* (2006.01)

(52) U.S. Cl. ..... 445/55; 445/53; 445/56; 445/57

(58) Field of Classification Search ..... 445/55, 445/53, 56, 57

See application file for complete search history.

(56) References Cited

U.S. PATENT DOCUMENTS

| | | | | |
|---|---|---|---|---|
| 5,912,531 | A | 6/1999 | Hasegawa et al. | |
| 5,977,706 | A | 11/1999 | Cho et al. | 313/553 |
| 6,139,390 | A * | 10/2000 | Pothoven et al. | 445/41 |
| 6,194,830 | B1 | 2/2001 | Cho et al. | 313/553 |
| 6,313,571 | B1 | 11/2001 | Hasegawa et al. | |
| 6,409,566 | B1 | 6/2002 | Hasegawa et al. | |
| 6,489,720 | B1 | 12/2002 | Gofuku et al. | |
| 6,559,596 | B1 | 5/2003 | Arai et al. | |
| 6,943,492 | B2 | 9/2005 | Miura et al. | |
| 6,988,921 | B2 | 1/2006 | Miura et al. | |
| 7,143,927 | B2 | 12/2006 | Hasegawa et al. | |
| 2007/0273267 | A1 | 11/2007 | Miura et al. | |

FOREIGN PATENT DOCUMENTS

| | | |
|---|---|---|
| JP | 2001-508586 | 6/2001 |
| WO | WO 98/26443 | 6/1998 |

* cited by examiner

*Primary Examiner* — Toan Ton
*Assistant Examiner* — Zachary Snyder
(74) *Attorney, Agent, or Firm* — Fitzpatrick, Cella, Harper & Scinto

(57) ABSTRACT

A manufacturing method of an image display apparatus, having a vacuum container with getters therein, includes the steps of exhausting an inner gas through an exhaust hole provided in the vacuum container; and activating the getters during the exhausting. In the activating step, the getters are sequentially activated first from a getter positioned in an area having a larger exhaust conductance with respect to the exhaust hole.

3 Claims, 3 Drawing Sheets

MANUFACTURING METHOD OF IMAGE DISPLAY APPARATUS

BACKGROUND OF THE INVENTION

1. Field of the Invention

The present invention relates to a manufacturing method of an image display apparatus having a vacuum container, an inside of which is maintained under a high vacuum state.

2. Description of the Related Art

An image display apparatus using a vacuum container, such as vacuum fluorescent display (VFD) or surface-conduction electron-emitter display (SED), has getters in the container to maintain the inside of the vacuum container under a high vacuum state.

Generally, there are evaporable type and non-evaporable type getters. Either type of getter requires activation in an exhaust process for exhausting gas in the vacuum container before sealing the container.

Japanese Patent Application Laid-Open No. 2001-508586 discloses a method for locally irradiating the getters with light energy for the activation.

SUMMARY OF THE INVENTION

The getter is a member for maintaining a high degree of vacuum in the vacuum container after sealing, and preferably the activation thereof exhibits high exhaust performance.

An object of the present invention is to provide a manufacturing method of an image display apparatus that activates getters to exhibit higher exhaust performance after sealing a vacuum container.

The present invention provides a manufacturing method of an image display apparatus having a vacuum container including getters therein, the method including the steps of: exhausting an inner gas through an exhaust hole provided on the vacuum container; and activating the getters during the exhausting, wherein, in the activating, the getters are sequentially activated from a getter positioned in an area having a larger exhaust conductance with respect to the exhaust hole.

According to the present invention, there is provided a highly reliable image display apparatus capable of restraining deterioration of a functional member such as an electron-emitting device due to residual gas in the container by realizing getters with high exhaust performance in the whole vacuum container.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

During an exhaust process according to the present invention, inner gas is exhausted by a molecular flow while a vacuum container is being exhausted. If a flow of gas being exhausted is a molecular flow, an exhaust conductance is approximately proportional to a sectional area of an inside of the vacuum container and inversely proportional to a distance from an exhaust hole and therefore the exhaust conductance becomes smaller as the distance from an exhaust hole 5 increases. Accordingly, the vicinity of the exhaust hole 5 has a high exhaust conductance, which provides a high degree of vacuum during the exhausting. The getter exhibits higher exhaust performance when a degree of vacuum in an atmosphere is higher during the activation.

In other words, when the getter is activated in a region where the exhaust conductance from the exhaust hole is high, the getter can exhibit high exhaust performance. The getter which has exhaust performance absorbs, from that position, gas in a region where the exhaust conductance is high, so that a region where a degree of vacuum is high expands to a periphery thereof.

Accordingly, when the activation is sequentially performed from a getter in a region where an exhaust conductance with respect to the exhaust hole is the highest to a getter in a region where an exhaust conductance is low, all getters can be activated under a high degree of vacuum. Hence, in the whole vacuum container, high exhaust performance can be exhibited at all the getters.

In an activation process according to the present invention, the sequential activation from a position of high exhaust conductance, that is, the local heating is performed, so that it is not necessary to heat the whole vacuum container as seen in the conventional activation by the total heating. Thus, the time required to heat and cool a panel can be reduced. Further, functional degradation due to the heating of a functional member such as an electron-emitting device can be restrained. The functional degradation is caused by a large amount of exhaust gas from the inside of the vacuum container during the total heating of the vacuum container.

Now, embodiments of the present invention will be described below.

The image display apparatus to which the manufacturing method of the present invention is applied includes a vacuum fluorescent display (VFD), a surface-conduction electron-emitter display (SED), a field emission display (FED) and a cathode ray tube (CRT). Particularly, VFD, SED and FED using a slim-type vacuum container have a low exhaust conductance over the whole container and tend to have a low degree of vacuum in activating a getter and therefore the present invention is preferably applied thereto.

Figure 1A:
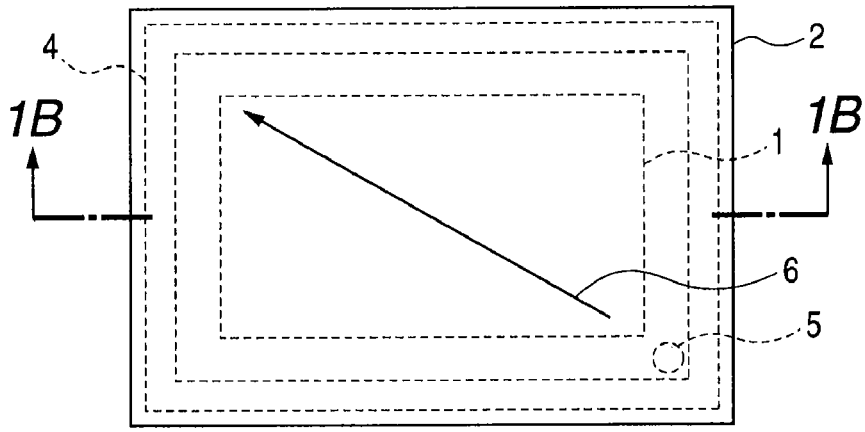
FIGS. 1A and 1B are schematic views illustrating a configuration during the activation of a vacuum container of an example of an image display apparatus according to the present invention, respectively.
Figure 1B:
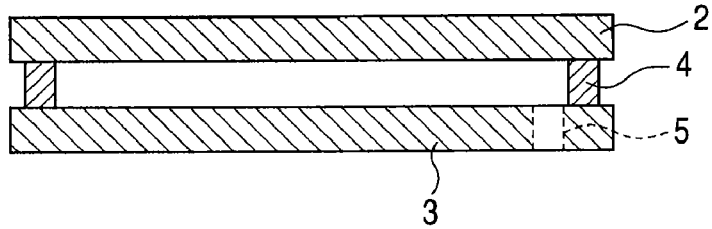

FIG. 1A is a schematic plane view of a configuration during the activation of a vacuum container of an example of an image display apparatus having a slim-type vacuum container and FIG. 1B is a schematic sectional view taken along line 1B-1B of FIG. 1A.

In a getter formation region 1 illustrated in FIG. 1A, which is surrounded by a broken line, getters are arranged at a plurality of positions. As the getters, either one of evaporable type and non-evaporable type is available, but it is preferable to use the non-evaporable type because the non-evaporable type does not scatter getter material during the activation and does not have an adverse effect upon another member in the vacuum container.

On a face plate 2, a light-emitting member such as a phosphor for forming an image is disposed. A rear plate 3 includes an electron-emitting device for lighting the light-emitting member positioned on the face plate 2. The getter 1 may be formed on either one of the face plate 2 and the rear plate 3. A support frame 4 maintains an interval between the face plate 2 and the rear plate 3 and an exhaust hole 5 is provided in the rear plate 3 to exhaust air to create a vacuum inside of the vacuum container. The exhaust hole 5 is sealed, after an activation process is completed and the inside of the container has been exhausted to create a sufficiently high vacuum. The exhaust hole 5 is disposed in a preferable quantity and position depending upon exhaust performance and image region.

These members are assembled, aligned, and sealed. As a sealing member, it is preferable to employ metal containing alloy or glass frit, which maintains vacuum tightness and causes little degassing. Direct sealing without use of a sealing member may also be applied. As a sealing method, it is preferable to employ a method for melting and solidifying the sealing member by the total heating or the local heating and a method for activating a bonded surface by a high energy beam or a short-pulse energy beam for direct bonding.

After the sealing, an exhaust process for exhausting gas in the vacuum container is performed by a local exhaust method for performing exhaust with a pump by connecting an exhaust pipe to the exhaust hole or a total exhaust method for exhausting the sealed vacuum container in a vacuum chamber while exhausting the whole chamber.

In the present invention, the local activation of getters is performed during the exhaust process. As an activation method, it is preferable to employ laser heating, high-frequency heating, heater heating or lamp heating. More preferably, the laser heating is employed that has a little influence upon another member and is capable of selectively heating only a desired getter.

An arrow 6 in FIG. 1A indicates the order of the activation and illustrates that the activation is sequentially performed from the vicinity of the exhaust hole 5 which has a high exhaust conductance from the exhaust hole 5 toward a remote portion in the direction of the opposite corner on the plates 2 and 3.

Figure 4:
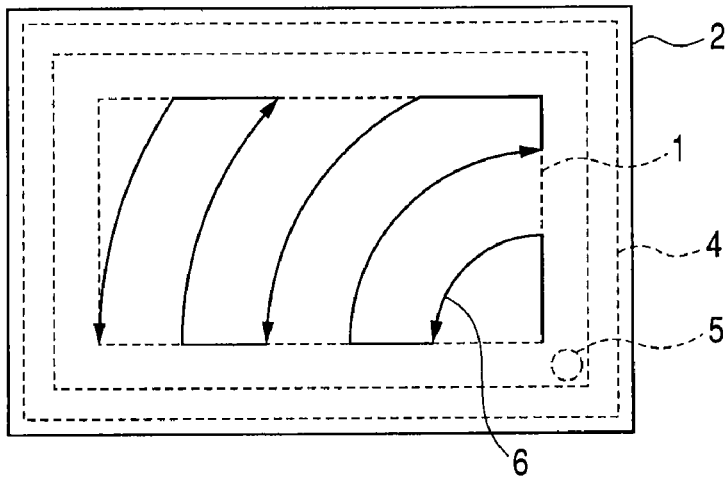
FIG. 4 is a schematic view illustrating the order of the activation in the image display apparatus of the same configuration as in FIGS. 1A and 1B.
Figure 5:
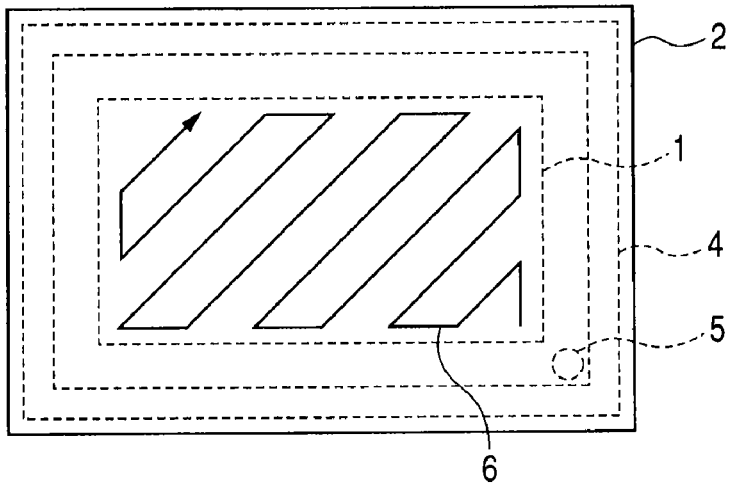
FIG. 5 is a schematic view illustrating the order of the activation in the image display apparatus of the same configuration as in FIGS. 1A and 1B.
Figure 6:
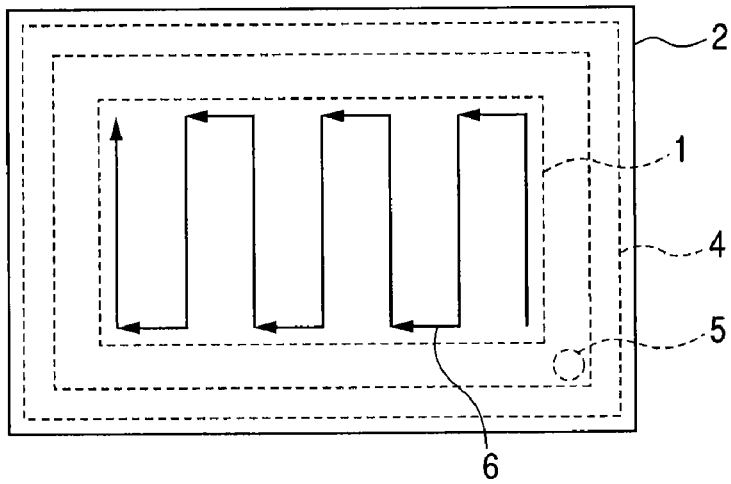
FIG. 6 is a schematic view illustrating the order of the activation in the image display apparatus of the same configuration as in FIGS. 1A and 1B.

With respect to more detailed order of the activation from the vicinity of the exhaust hole 5 toward a remote portion, the overall order along the arrow 6 is preferable. Concretely, it is preferable to perform the activation in the order illustrated by the arrow 6 in FIGS. 4 to 6. More preferably, the precise activation is performed from the exhaust hole 5 toward a remote portion, as illustrated in FIG. 4.

Figure 2A:
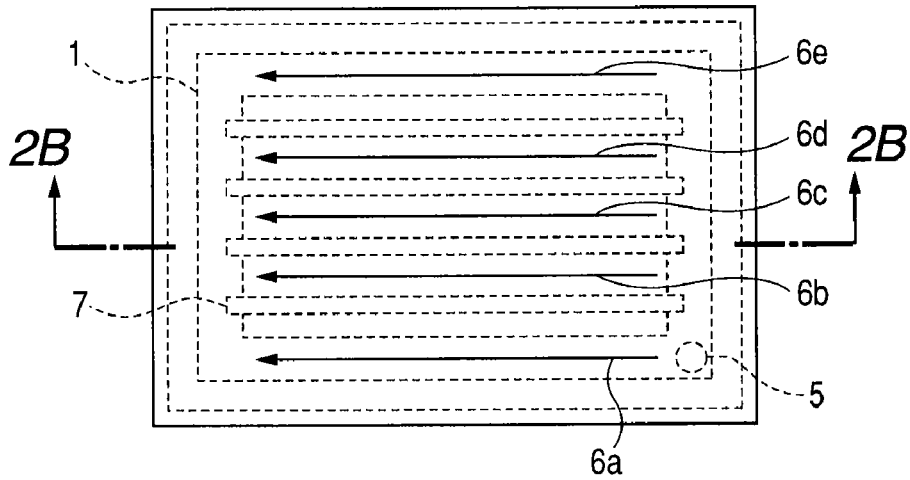
FIGS. 2A and 2B are schematic views illustrating the order of the activation in an image display apparatus having a spacer.
Figure 2B:
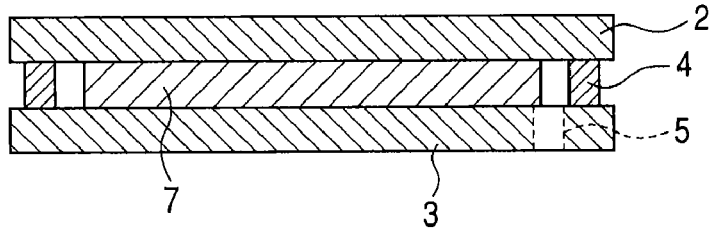

If a member having an influence upon exhaust conductance like a spacer 7 defining a space between the face plate 2 and the rear plate 3 exists in the container as illustrated in FIGS. 2A and 2B, preferably, the activation order is the order of 6*a*, 6*b*, 6*c*, 6*d* and 6*e*.

Figure 3A:
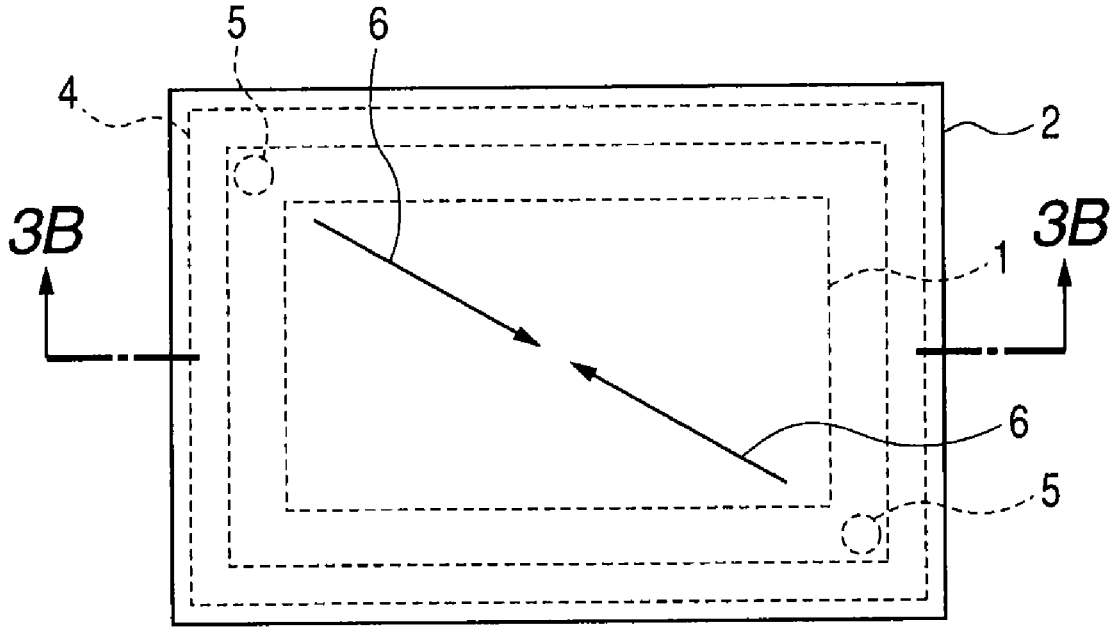
FIGS. 3A and 3B are schematic views illustrating the order of the activation in an image display apparatus having a plurality of exhaust holes, respectively.
Figure 3B:
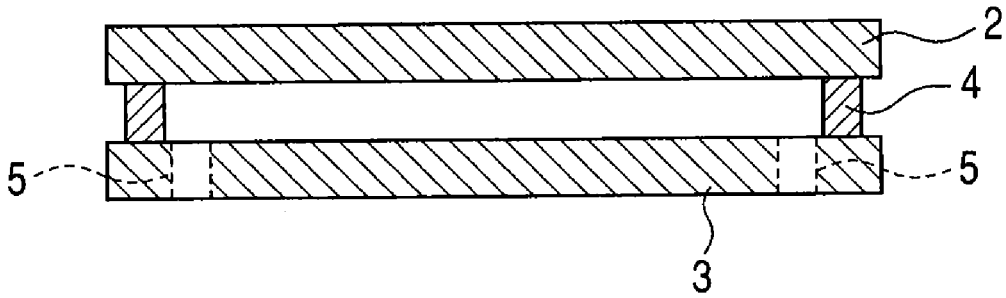

Further, if a plurality of exhaust holes 5 exists as illustrated in FIGS. 3A and 3B, the activation may be sequentially performed from the one exhaust hole 5 to a central portion of the region 1 and then from the other exhaust hole 5 toward the central portion. Alternatively, the activation may be sequentially performed from the respective exhaust holes 5 simultaneously toward a central portion having a low exhaust conductance.

EXAMPLES

Hereafter, detailed description will be made on the present invention with reference to examples of the present invention.

Example

A vacuum container having a configuration illustrated in FIGS. 1A and 1B was prepared.

First, on a glass substrate of 70 mm×50 mm×1.8 mm (t), a Cu wiring for supplying a driving potential was formed by means of a plating method and a surface conduction type electron-emitting device was formed by means of a sputtering method, respectively, to prepare a rear plate 3.

Next, on a glass substrate of the same size, a phosphor was formed by means of a screen printing method and an Al metal back was formed by means of a vapor deposition method to prepare a face plate 2. On the face plate 2, Ti was vapor-deposited with a thickness of 340 nm within a region 1 illustrated in FIG. 1A by means of a sputtering method to obtain a non-evaporable type getter.

The face plate 2 and the rear plate 3 were sealed by the local heating with Al as a sealing member using a laser diode having a wavelength of 808 nm through a support frame 4 of 35 mm×10 mm×1.6 mm (t).

An exhaust hole 5 in the vacuum container was connected to a vacuum pump and the exhausting was performed while monitoring with a vacuum gauge so that a degree of vacuum at the vicinity of the exhaust hole 5 was $10^{-3}$ Pa or less.

After a desired degree of vacuum had been reached, the non-evaporable type getter was locally heated from the face plate 2 side using the laser diode having a wavelength of 808 nm. At this time, a radiation thermometer having a wavelength of 1.55 μm concurrently passing through glass from the face plate 2 side was used. An irradiation spot diameter was fixed to 10 mm so that a temperature of the non-evaporable type getter was 350° C., the power of the laser diode was controlled and the activation of the non-evaporable type getter was performed.

As shown by the arrow 6 in FIG. 4, scanning of the local heating with the laser diode was performed from the vicinity of the exhaust hole 5 toward a remote portion while an arc of a concentric circle was being gradually enlarged from the vicinity of the exhaust hole 5 so as to draw the concentric circle with respect to the center of the exhaust hole 5.

After the exhausting and activation, the exhaust hole 5 was sealed with a lid for sealing of the vacuum container.

The activation method for the non-evaporable type getter was the local heating, and thus it took a short period of time to raise and lower the temperature. Accordingly, significant time reduction was achieved compared to the case where the activation was performed by the conventional total heating.

According to the measurement of the performance of the non-evaporable type getter activated by the above-described method, it was realized that the performance was improved in both exhaust rate and total displacement compared to the case of activation by the total heating.

Further, in assembling and driving the image display apparatus using the vacuum container, it was realized that deterioration of an electron-emitting device was reduced compared to the conventional activation of getters by the total heating.

Comparative Example

In a manner contrary to that of the above example, the activation was sequentially performed from a remote portion of the exhaust hole 5 toward the vicinity of the exhaust hole 5 while a radius of the local heating of getters was being gradually increased in a concentric-circle manner from a point positioned at the opposite corner of the exhaust hole 5.

According to the measurement of the exhaust performance of the vacuum container after the activation, it was realized that the performance is lower in both exhaust rate and total displacement than the embodiment described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Laid-Open No. 2008-206567, filed Aug. 11, 2008, hereby incorporated by reference herein in its entirety.

What is claimed is:

1. A manufacturing method of an image display apparatus having a vacuum container comprising a getter therein, the method comprising the steps of:

exhausting an inner gas through a plurality of exhaust holes provided in the vacuum container; and activating the getter during the exhausting, wherein, in the activating step, the getter is first activated in a first region where an exhaust conductance with respect to a first exhaust hole is highest and simultaneously in a second region where an exhaust conductance with respect to a second exhaust hole is highest.

2. A manufacturing method according to claim 1, further comprising the step of sealing the vacuum container.

3. A manufacturing method according to claim 1, wherein in the activating step the getter is activated last in a region where the exhaust conductance is lowest.

* * * * *